US007383898B2

(12) United States Patent
Downton

(10) Patent No.: US 7,383,898 B2
(45) Date of Patent: Jun. 10, 2008

(54) INNER AND OUTER MOTOR WITH ECCENTRIC STABILIZER

(75) Inventor: Geoff Downton, Minchinhampton (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 30 days.

(21) Appl. No.: 10/560,768

(22) PCT Filed: Jun. 23, 2003

(86) PCT No.: PCT/GB03/02698

§ 371 (c)(1),
(2), (4) Date: Apr. 18, 2006

(87) PCT Pub. No.: WO2004/113664

PCT Pub. Date: Dec. 29, 2004

(65) Prior Publication Data

US 2006/0243492 A1 Nov. 2, 2006

(51) Int. Cl.
*E21B 4/00* (2006.01)
*E21B 17/10* (2006.01)

(52) U.S. Cl. ..... 175/107; 175/325.1

(58) Field of Classification Search ..... None
See application file for complete search history.

(56) References Cited

U.S. PATENT DOCUMENTS

| | | | | |
|---|---|---|---|---|
| 4,319,649 | A * | 3/1982 | Jeter | 175/73 |
| 4,646,856 | A * | 3/1987 | Dismukes | 175/107 |
| 4,817,740 | A * | 4/1989 | Beimgraben | 175/74 |
| 5,611,397 | A * | 3/1997 | Wood | 166/68 |
| 7,030,528 | B2 * | 4/2006 | Morgante | 310/112 |

* cited by examiner

*Primary Examiner*—Frank S Tsay
(74) *Attorney, Agent, or Firm*—Andrus, Sceales, Starke & Sawall, LLP

(57) ABSTRACT

A downhole motor arrangement for a directional drilling comprises a first motor component (22), a second motor component (24) encircling at least part of the first motor component (22), and a third motor component (26) encircling at least part of the second motor component (24), the first and second motor components (22, 24) having surfaces associated therewith adapted to define isolated cavities, the application of fluid under pressure thereto causing relative rotation between the first and second motor components (22, 24), the second and third motor components (24, 26) having surfaces associated therewith adapted to define isolated cavities, the application of fluid under pressure thereto causing relative rotation between the second and third motor components (24, 26).

10 Claims, 3 Drawing Sheets

INNER AND OUTER MOTOR WITH ECCENTRIC STABILIZER

This invention relates to a motor arrangement, and in particular to a motor arrangement suitable for use in downhole applications, for example for use in driving a drill bit for use in the formation of a wellbore.

It is known to use drilling fluid or mud supplied to a downhole location under pressure to drive a downhole motor. Motors used in such applications include a range of motors which operate on the same principle as progressive cavity pumps but are operated such that the supply and passage of fluid causes rotation of a rotor rather than rotation of a rotor relative to a stator driving fluid though the pump. A particular design of motor of this type commonly used in such applications is a Moineau motor which comprises a rotor of helical form rotatable within an elastomeric stator. The rotor and stator are both shaped so as to form a series of isolated cavities therebetween arranged such that the application of fluid under pressure thereto causes the rotor to rotate relative to the stator thereby allowing fluid to pass through the stator.

Downhole motors which operate in this manner are described in, for example, U.S. Pat. No. 5,174,392 and U.S. Pat. No. 5,611,397.

It is desirable to be able to provide downhole drilling systems which are steerable. One technique which has been considered to allow the provision of a steerable drilling system is to locate an eccentric stabiliser adjacent the drill bit of the system, thereby applying a side load to the drill bit to cause the formation of a curve in the borehole being drilled. It will be appreciated that for such a system to operate correctly, it is necessary to be able to correctly orientate the eccentric stabiliser as this determines the direction in which the borehole is formed. It is also important to ensure that, once positioned in the desired orientation, the eccentric stabiliser remains in the desired orientation. It has been found to be difficult to ensure that the stabiliser remains in its desired orientation when a progressive cavity type motor is used to drive the drill bit, the orientation of the stabiliser tending to change for example as a result of the reaction forces generated by the operation of the motor.

It is an object of the invention to provide a motor arrangement suitable for use in such applications.

According to the present invention there is provided a motor arrangement comprising a first motor component, a second motor component encircling at least part of the first motor component, and a third motor component encircling at least part of the second motor component, the first and second motor components having surfaces associated therewith adapted to define isolated cavities, the application of fluid under pressure thereto causing relative rotation between the first and second motor components, the second and third motor components having surfaces associated therewith adapted to define isolated cavities, the application of fluid under pressure thereto causing relative rotation between the second and third motor components.

It is envisaged, that, in one configuration, the second motor component is secured to a drill string, the first motor component to a drill bit and the third motor component to an eccentric stabiliser. By appropriate control of the fluid applied to the cavities between the first and second motor components and between the second and third motor components the motor arrangement may be controlled such that the third motor component, and hence the eccentric stabiliser, remain stationary, when desired.

The said surfaces associated with the first and second motor components may be shaped to form a first Moineau motor, the said surfaces associated with the second and third motor components conveniently being shaped to form a second Moineau motor.

A first one of the said surfaces forming the first Moineau motor is of flexible form, shaped to define a helix. The said first surface is conveniently provided on or associated with the second motor component, but could alternatively be provided on the first motor component. Likewise, a first one of the said surfaces forming the second Moineau motor is of flexible form, shaped to define a helix, and is preferably provided on or associated with the third motor component but could alternatively be provided on the second component.

The third motor component may form part of the eccentric stabiliser. Alternatively, the eccentric stabilizer may be mounted upon or secured to the third motor component. The manner in which the eccentric stabilizer is secured to the third motor component may be such as to transmit angular movement, but not radial movement, of the third motor component to the eccentric stabilizer.

According to another aspect of the invention there is provided a motor arrangement comprising an inner motor and an outer motor encircling at least part of the inner motor. The inner and outer motors are preferably fluid driven, and may comprise inner and outer Moineau motors.

The invention will further be described, by way of example, with reference to the accompanying drawings, in which.

Figure 1:
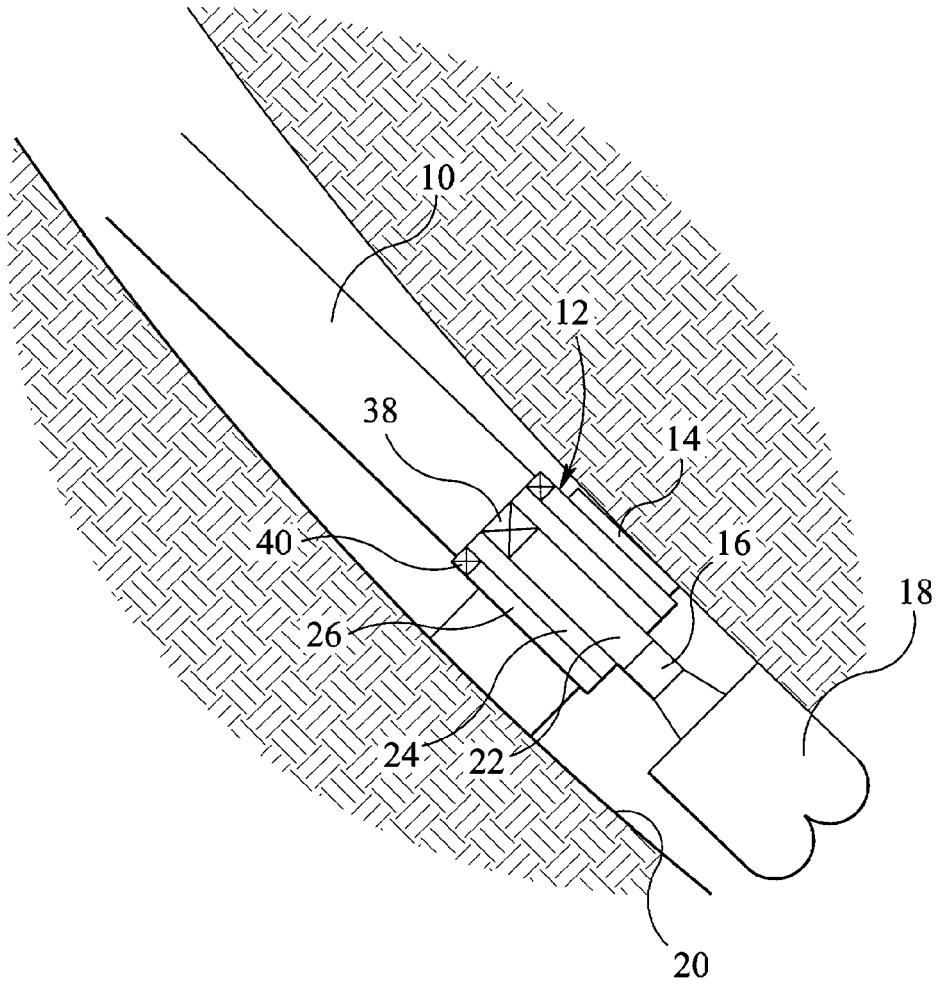
FIG. 1 is a diagrammatic view of a motor arrangement in accordance with an embodiment of the invention, in use.

FIG. 1 illustrates part of a downhole drilling arrangement comprising a drill string 10 arranged to carry a motor arrangement 12 upon which is mounted an eccentric stabiliser body 14. The motor arrangement 12 includes an output shaft 16 upon which is mounted a rotary drill bit 18. The motor arrangement 12 which will be described in greater detail hereinafter is of the mud or fluid driven type arranged such that the application of fluid under pressure to the motor arrangement 12 causes the drive shaft 16 to rotate relative to the drill string 10, thereby causing rotation of the drill bit 18 which acts to scrape or gouge material from the formation in which a borehole 10 is to be formed, in a known manner.

As illustrated, an eccentric stabiliser body 14 is provided. The purpose of the eccentric stabiliser body 14 is to stabilise the lower end of the drill string 10 relative to the borehole 20 and to apply a side loading to the drill bit 18 such that the drill bit 18 tends to form a curve in the borehole 20. This is achieved by using the stabiliser 14 to locate the lower end of the drill string 10 eccentrically within the borehole. The direction in which the borehole 20 deviates due to the presence of the eccentric stabiliser 14 will depend upon the angular orientation of the stabiliser body 14 relative to the borehole 20.

Figure 2:
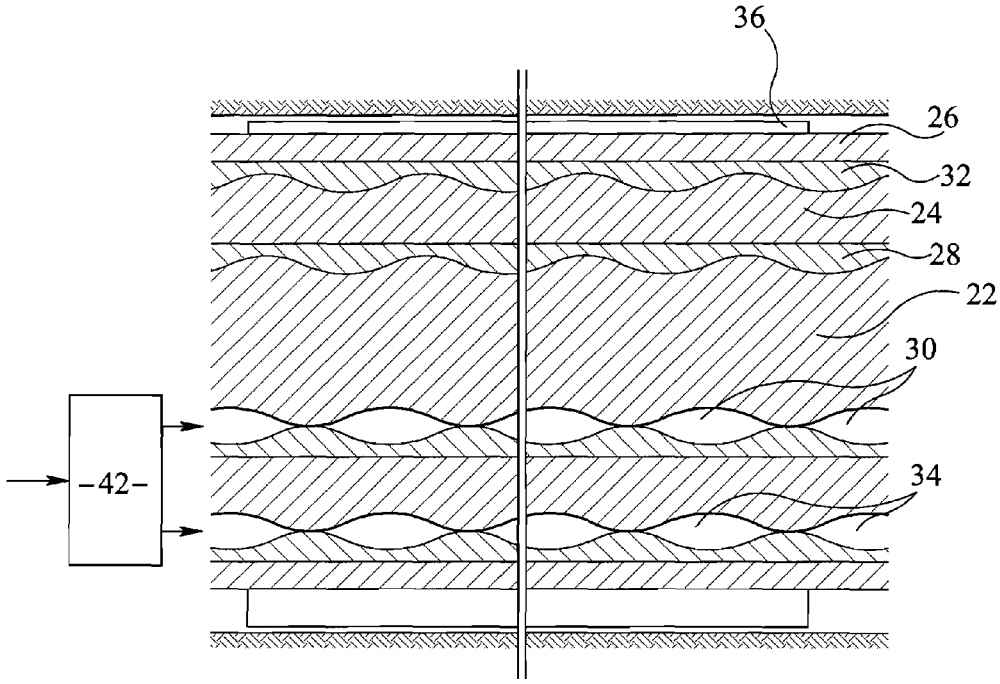
FIG. 2 is a diagrammatic sectional view of the motor arrangement.

Referring to FIG. 2, the motor arrangement 12 comprises a first motor component 22 in the form of an inner rotor, a second motor component 24 in the form of an intermediate stator member, and a third motor component 26 in the form of an outer rotor. The third motor component 26 is of tubular form, encircling at least part of the second motor component 24. Likewise, the second motor 24 is of tubular form and encircles part of the first motor component. The first motor component 22 comprises a steel body, the outer surface of which is provided with a helical groove formation which is co-operable with a similarly helically grooved component 28 of an elastomeric material which is secured to the interior surface of the second motor component 24. The shaping of the outer surface of the first motor component 22 and the inner surface of the component 28 form a plurality of isolated cavities 30, the axial positions of which are dependent upon the angular position of the first motor component 22 relative to the second component 24 at any given time. The design of these components is such that they form an inner Moineau motor.

The outer surface of the second motor component 24 is shaped to include a generally helical groove similar to that provided on the first motor component 22. The inner surface of the third motor component 26 is provided with a sleeve 32 of elastomeric material, the inner surface of which is shaped to include a generally helical groove arranged to co-operate with the generally helical groove formed in the outer surface of the second motor component 24 to define a plurality of isolated chambers 34. The design of these components is such that they form an outer Moineau motor.

The outer surface of the third motor component 26 carries a body 36 forming part of the eccentric stabiliser 14. As illustrated in FIG. 2, the body 36 is designed to be of eccentric form such that the motor arrangement 12 is located eccentrically within the borehole, relatively close to one side of the borehole 20 being formed, and spaced by a greater distance from the opposing side of the borehole 20.

As shown in FIG. 1, the second motor component 24 is rigidly secured to the drill string 10 so as to be rotatable and axially moveable therewith. The first motor component 22 is rotatable relative to the drill string 10, bearings 38 being provided to allow such relative rotary motion, the bearings 38 serving as a thrust bearing, thereby limiting relative axial movement between the rotor 22 and the drill string 10. Likewise, a thrust bearing 40 is provided between the third motor component 26 and the drill string 10, to allow relative rotation therebetween but limit relative axial motion.

In use, drilling fluid is supplied to the borehole 20 under pressure. The drilling fluid is forced into an end most one of the cavities 30 formed between the first and second motor components 22, 24. The application of fluid under pressure to this chamber causes the rotor 22 to move angularly relative to the second motor component 24. As the second motor component 24 is held against angular movement relative to the drill string 10, it will be appreciated that the application of fluid under pressure causes the first motor component 22 to rotate. The first motor component 22 is secured to or forms part of the output shaft 16 of the motor arrangement 12, thus it will be appreciated that the application of fluid under pressure causes the drive shaft 16, and hence the drill bit 18 to rotate relative to the drill string.

As well as being supplied to the cavities 30, fluid under pressure is also supplied to the cavities 34 between the second and third motor components 24, 26. The application of fluid under pressure to these cavities causes the third motor component 26 to rotate relative to the second motor component 24, such rotation of the third motor component 26 being permitted by the presence of the bearings 40. The orientation of the helical grooves which define the cavities 34 is such that the application of fluid under pressure to the cavities 34 causes the third motor component 26 to rotate in a direction opposite to the direction of the rotation of the drill string 10, in use.

As shown diagrammatically in FIG. 2, a valve arrangement 42 is provided to control the supply of fluid under pressure to the cavities 30, 34. The valve arrangement 42 usually controls the supply of fluid to the cavities 34 located between the second and third motor components 24, 26 such that the speed of rotation of the third motor component 26 relative to the second motor component 24 is equal to the speed of rotation of the drill string 10 at any given time. As a result, it will be appreciated that the third motor component 26 remains stationary, in use. The supply of fluid under pressure to the cavities 30 by the valve 42 ensures that the drive shaft 16 is rotated at a speed greater than the speed of rotation of the drill string 10.

It will be appreciated that as the third motor component 26 remains stationary, in use, the body 36 forming part of the eccentric stabiliser 14 also remains angularly stationary, in use. If it is determined, for example using the output of a proximity sensor mounted on the motor to determine the position of the motor within the borehole, in combination with other parameters, that the angular orientation of the eccentric stabiliser 14 is not the desired orientation, then by appropriate control of the valve 42, an increase or a decrease in the supply of fluid to the cavities 34 between the second and third motor components 24, 26 may be used to increase or decrease the speed of rotation of the third motor component 26 to bring the eccentric stabiliser 14 to the desired angular position whereafter control of the valve 42 may be returned to the condition in which the eccentric stabiliser unit 14 is held in the desired angular position.

Although in the illustrated embodiment elastomeric material 28 is provided upon the interior surface of the second motor component, and upon the inner surface of the third motor component 26, this need not be the case, and instead the inner surface of the second motor component 26 could be grooved, a suitably shaped elastomeric component being fitted to or forming part of the first motor component 22, and likewise an elastomeric material may be provided upon the outer surface of the second motor component 24, the elastomeric material co-operating with a groove formed on the inner surface of the third motor component 26 to form the cavities 34 in such an arrangement. Further, although the description hereinbefore is of the use of a pair of motors of the Moineau type, on of the Moineau motors being located within the other of the Moineau motors, it will be appreciated that the invention is applicable to other types of motor, for example other types of progressive cavity motor. Further, although in the described embodiment the inner and outer Moineau motors are axially aligned with one another, this need not be the case, and arrangements are possible in which an outer one of the Moineau motors is axially spaced from an inner motor.

Figure 3:
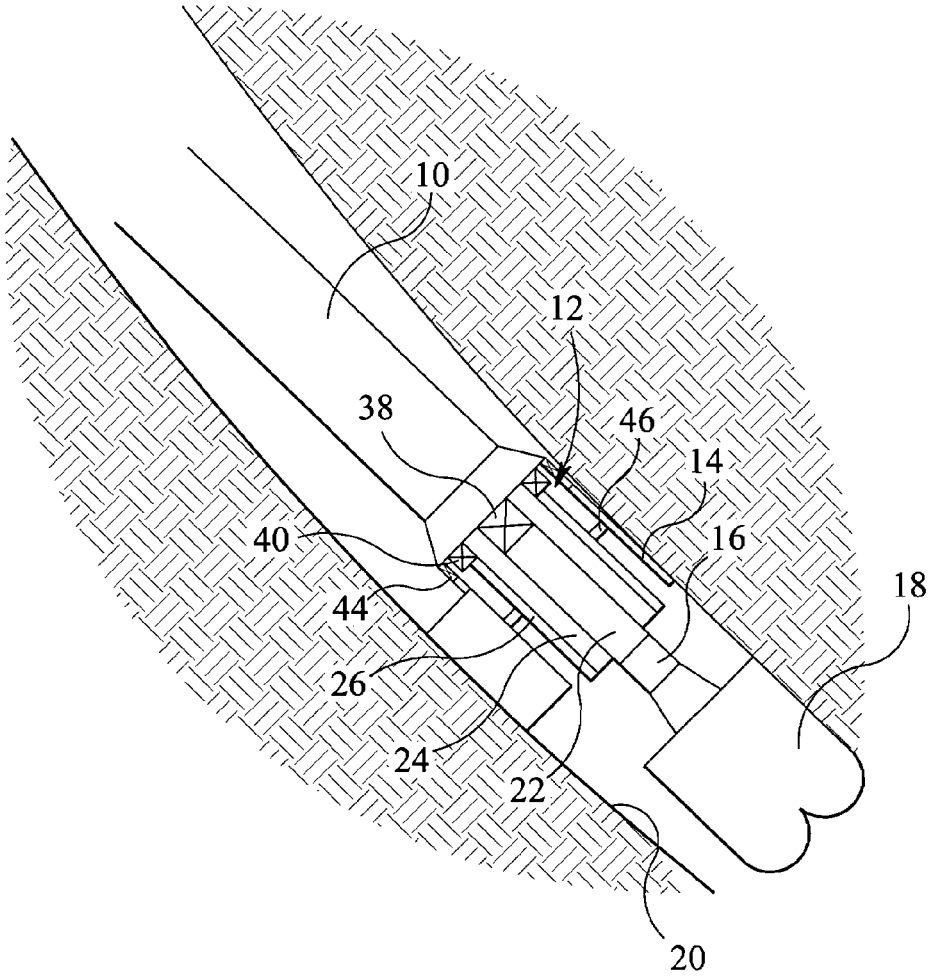
FIG. 3 is a view similar to FIG. 1 illustrating an alternative arrangement.

In use, some radial mutation of the third motor component 26 may occur. Where the eccentric stabilizer body 36 is mounted directly upon the third motor component 26, the body 36 will also undergo radial mutation, in use. Although this may be acceptable in some arrangements or applications, it may be desirable to mount the body 36 in such a manner that nutation of the third motor component 26 is not transmitted to the body 36, thereby avoiding radial nutation of the body 36. By way of example, as shown in FIG. 3, the body 36 may be mounted upon the drill string 10 through suitable bearings 44, the body 36 being radially spaced from the third motor component 26 such that radial nutation of the third motor component 26 does not affect the body 36, and providing a suitable drive arrangement 46 between the third motor component 26 and the body 36 to transmit angular, but not radial, movement of the third motor component 26 to the body 36.

With such an arrangement, nutation of the body 36 is avoided, but in the event that it is determined that the angular position of the body 36 should be changed, angular movement of the third motor component 26 achieved in the manner described hereinbefore with reference to FIGS. 1 and 2 causes the body 36 to be dragged or otherwise moved by the third motor component 26 to the new, desired, angular position.

Further alterations or modifications to the described system are possible. For example, the fluid flow to the cavities 34 may be in the opposing direction to the flow of fluid to the cavities 30 by appropriate porting and control of the flow of downhole fluids, if desired.

The invention claimed is:

1. A motor arrangement comprising a first motor component, a second motor component encircling at least part of the first motor component, and a third motor component encircling at least part of the second motor component, the first and second motor components having surfaces associated therewith adapted to define isolated cavities, the application of fluid under pressure thereto causing relative rotation between the first and second motor components, the second and third motor components having surfaces associated therewith adapted to define isolated cavities, the application of fluid under pressure thereto causing relative rotation between the second and third motor components.

2. An arrangement according to claim 1, wherein the second motor component is secured to a drill string, the first motor component to a drill bit and the third motor component to an eccentric stabilizer.

3. An arrangement according to claim 2, wherein the third motor component forms part of the eccentric stabilizer.

4. An arrangement according to claim 2, wherein the third motor component and eccentric stabilizer are secured to one another through a drive arrangement arranged to transmit angular but not radial movement of the third motor component to the eccentric stabilizer.

5. An arrangement according to claim 1, wherein the said surfaces associated with the third and second motor components are shaped to form a first Moineau motor.

6. An arrangement according to claim 5, wherein a first one of the said surfaces forming the first Moineau motor is of flexible form, and is shaped to define a helix.

7. An arrangement according to claim 1, wherein the said surfaces associated with the second and third motor components are shaped to form a second Moineau motor.

8. An arrangement according to claim 7, wherein a first one of the said surfaces forming the second Moineau motor is of flexible form, and is shaped to define a helix.

9. A stabilizer arrangement comprising an eccentric stabilizer mounted upon a downhole motor arrangement, the motor being operable to control the angular position occupied by the eccentric stabilizer, wherein the motor arrangement comprises a first motor component, a second motor component encircling at least part of the first motor component, and a third motor component encircling at least part of the second motor component, the first and second motor components having surfaces associated therewith adapted to define isolated cavities, the application of fluid under pressure thereto causing relative rotation between the first and second motor components, the second and third motor components having surfaces associated therewith adapted to define isolated cavities, the application of fluid under pressure thereto causing relative rotation between the second and third motor components.

10. An arrangement according to claim 9, wherein the motor arrangement comprises an inner motor and an outer motor encircling at least part of the inner motor.

* * * * *